US008104194B2

(12) United States Patent
Kim

(10) Patent No.: US 8,104,194 B2
(45) Date of Patent: Jan. 31, 2012

(54) SHOES HAVING IMPACT ABSORPTION PART

(76) Inventor: Suk Koung Kim, Seoul (KR)

( * ) Notice: Subject to any disclaimer, the term of this patent is extended or adjusted under 35 U.S.C. 154(b) by 434 days.

(21) Appl. No.: 12/515,270

(22) PCT Filed: Nov. 8, 2007

(86) PCT No.: PCT/KR2007/005606

§ 371 (c)(1),
(2), (4) Date: May 15, 2009

(87) PCT Pub. No.: WO2008/060065

PCT Pub. Date: May 22, 2008

(65) Prior Publication Data

US 2010/0236093 A1 Sep. 23, 2010

(30) Foreign Application Priority Data

Nov. 15, 2006 (KR) ..... 10-2006-0112580

(51) Int. Cl.
*A43B 13/28* (2006.01)
*A43B 7/32* (2006.01)

(52) U.S. Cl. ..... 36/27; 36/38

(58) Field of Classification Search ..... 36/27, 38, 36/35 R, 28, 7.8
See application file for complete search history.

(56) References Cited

U.S. PATENT DOCUMENTS

| | | | | |
|---|---|---|---|---|
| 1,099,180 | A * | 6/1914 | Karacsonyi | 36/38 |
| 4,715,130 | A * | 12/1987 | Scatena | 36/27 |
| 5,513,448 | A * | 5/1996 | Lyons | 36/28 |
| 5,621,984 | A * | 4/1997 | Hsieh | 36/28 |
| 5,649,374 | A * | 7/1997 | Chou | 36/27 |
| 6,282,814 | B1 * | 9/2001 | Krafsur et al. | 36/27 |
| 6,751,891 | B2 * | 6/2004 | Lombardino | 36/28 |
| 2003/0110661 | A1 * | 6/2003 | Wu | 36/27 |
| 2008/0313928 | A1 * | 12/2008 | Adams et al. | 36/103 |
| 2010/0139127 | A1 * | 6/2010 | Huang | 36/3 B |

FOREIGN PATENT DOCUMENTS

| | | |
|---|---|---|
| KR | 20-1996-0013115 | 5/1996 |
| KR | 20-0351578 | 5/2004 |
| KR | 20-0405434 | 1/2006 |
| KR | 10-2006-0022210 | 3/2006 |

* cited by examiner

*Primary Examiner* — Ted Kavanaugh
(74) *Attorney, Agent, or Firm* — Christopher Paul Mitchell

(57) ABSTRACT

The present invention relates to a shoe, and more particularly to a shoe including a mid-sole groove formed at a mid-sole, a texon hole formed at a texon, and an impact absorption member inserted between the mid-sole and the texon hole so that the shoe can absorb impact exerted on user's knees and ankles while the user walks or exercises, thereby protecting them.

4 Claims, 7 Drawing Sheets

[Fig. 1]
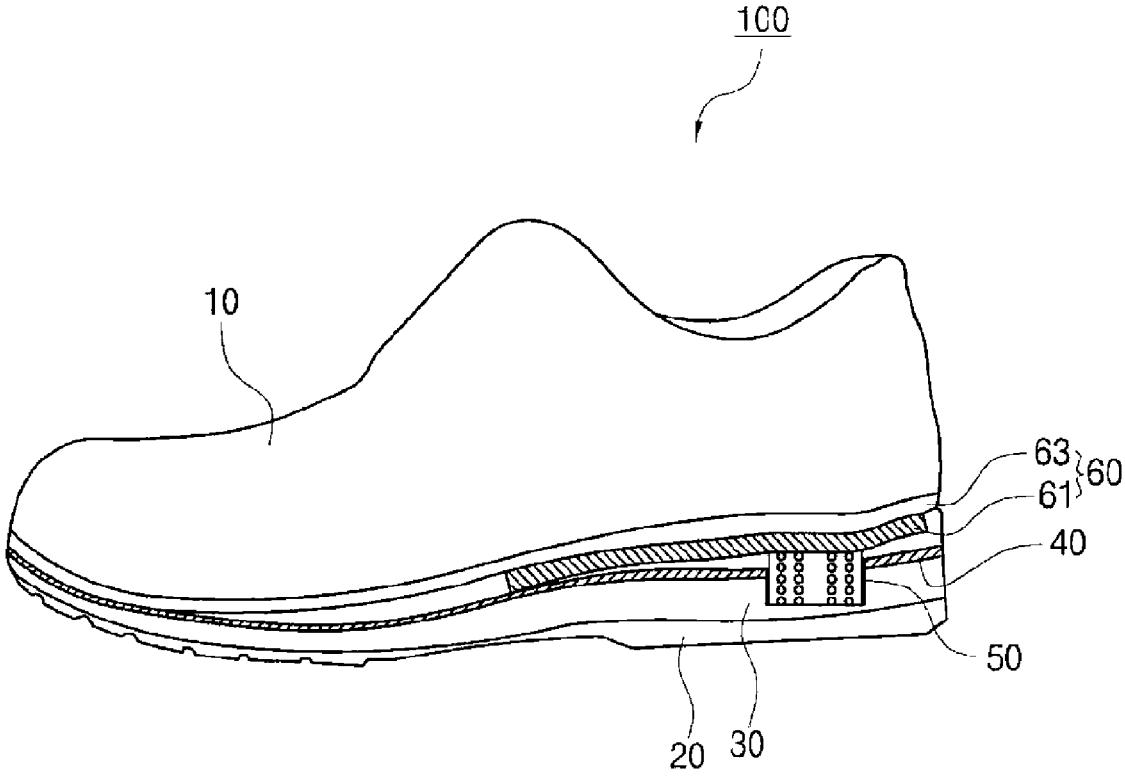

[Fig. 2]
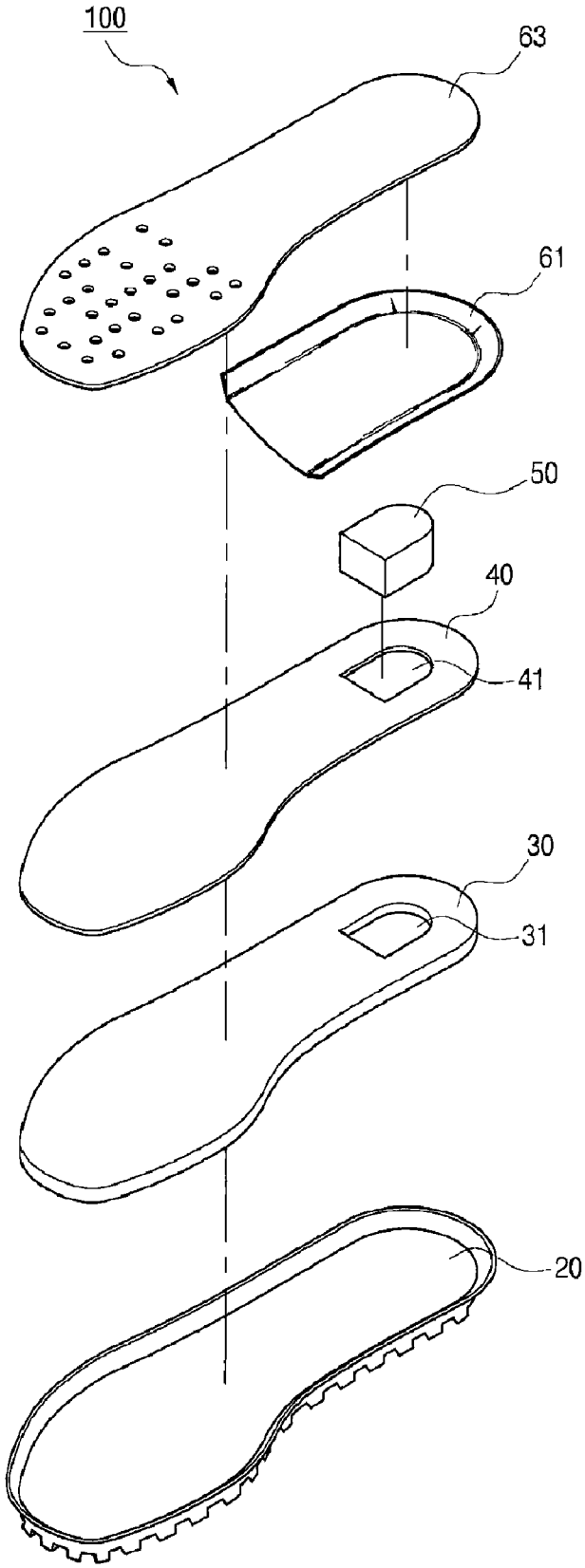

[Fig. 3]
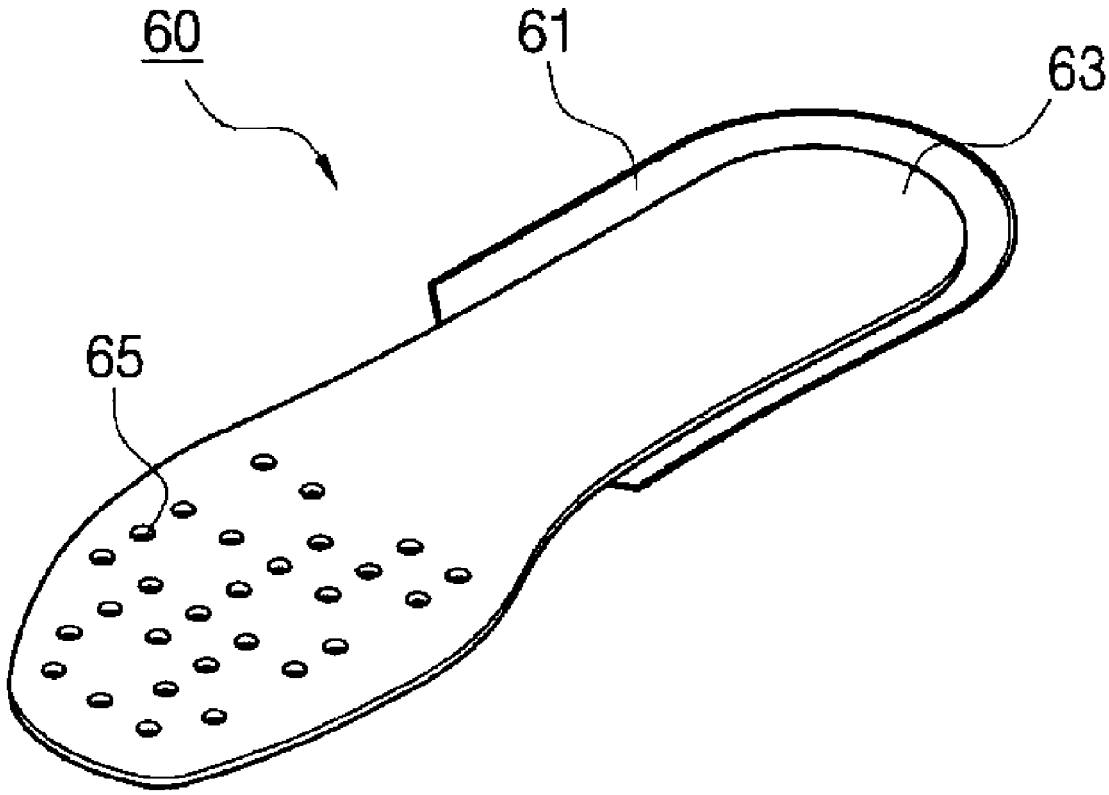

[Fig. 4]
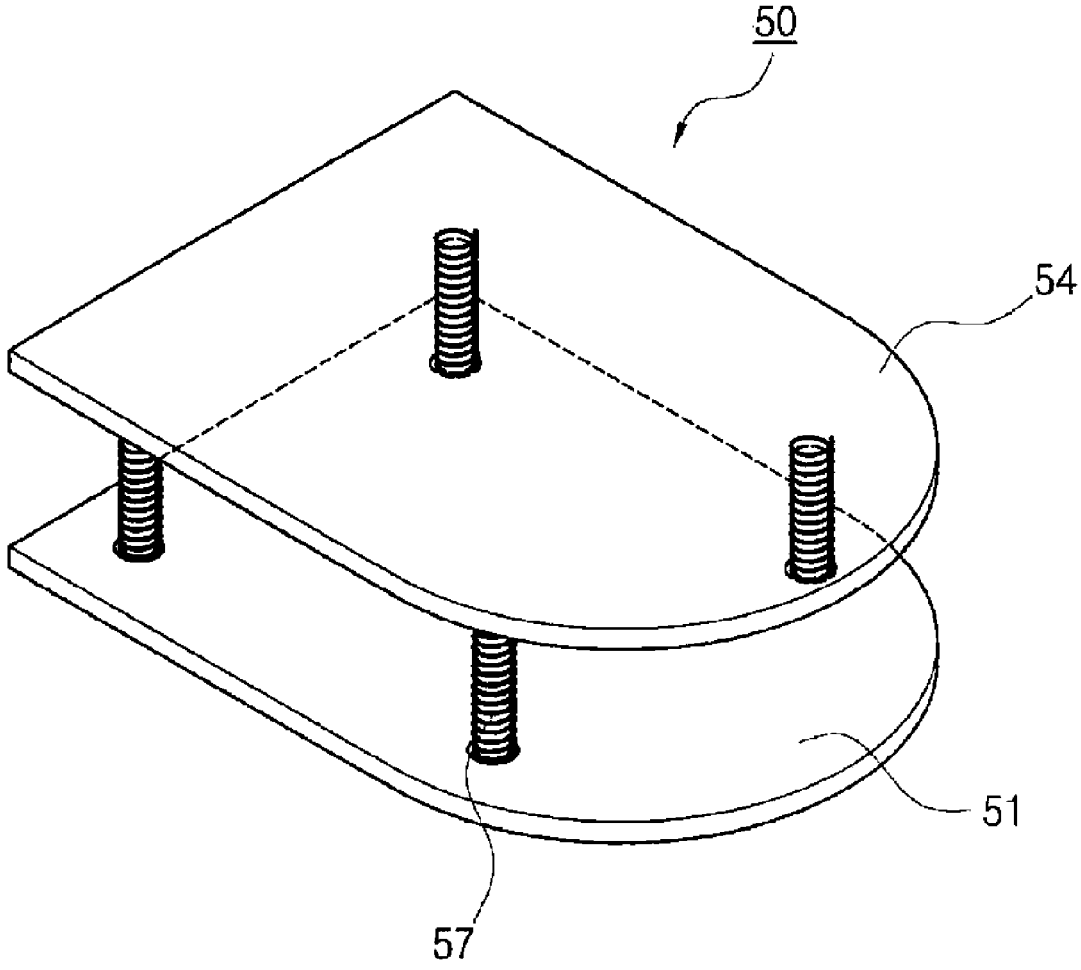

[Fig. 5]
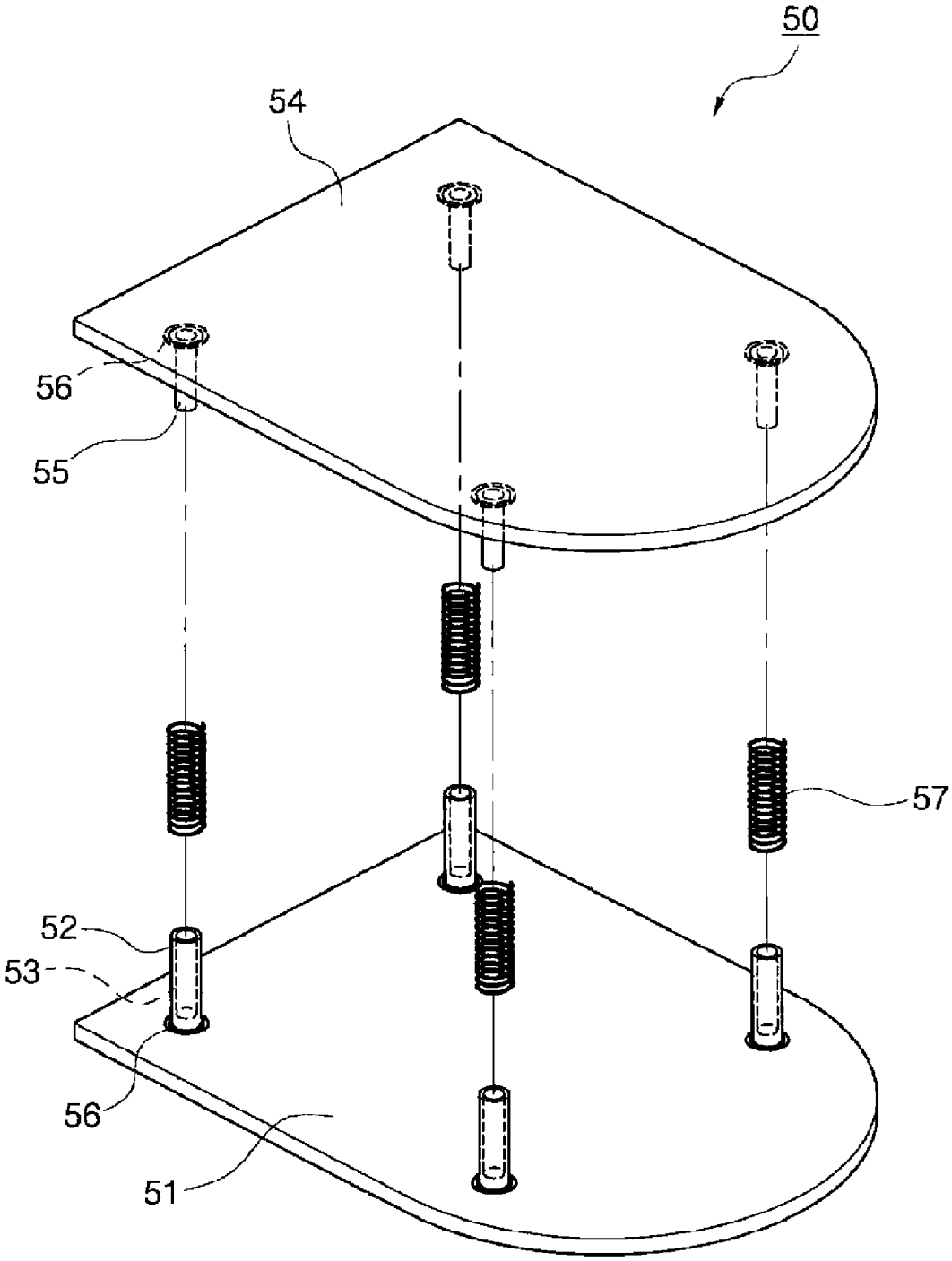

[Fig. 6]
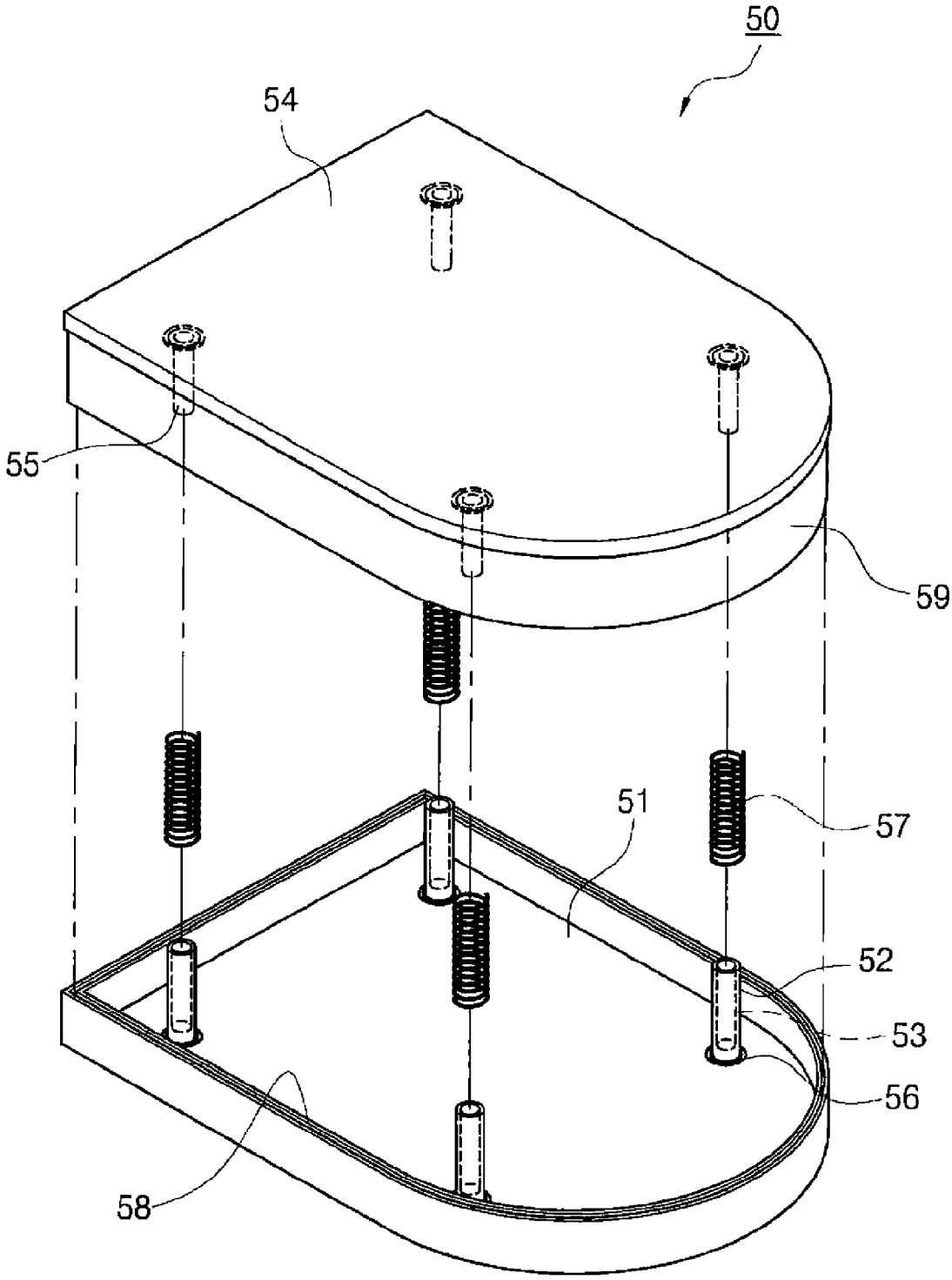

[Fig. 7]
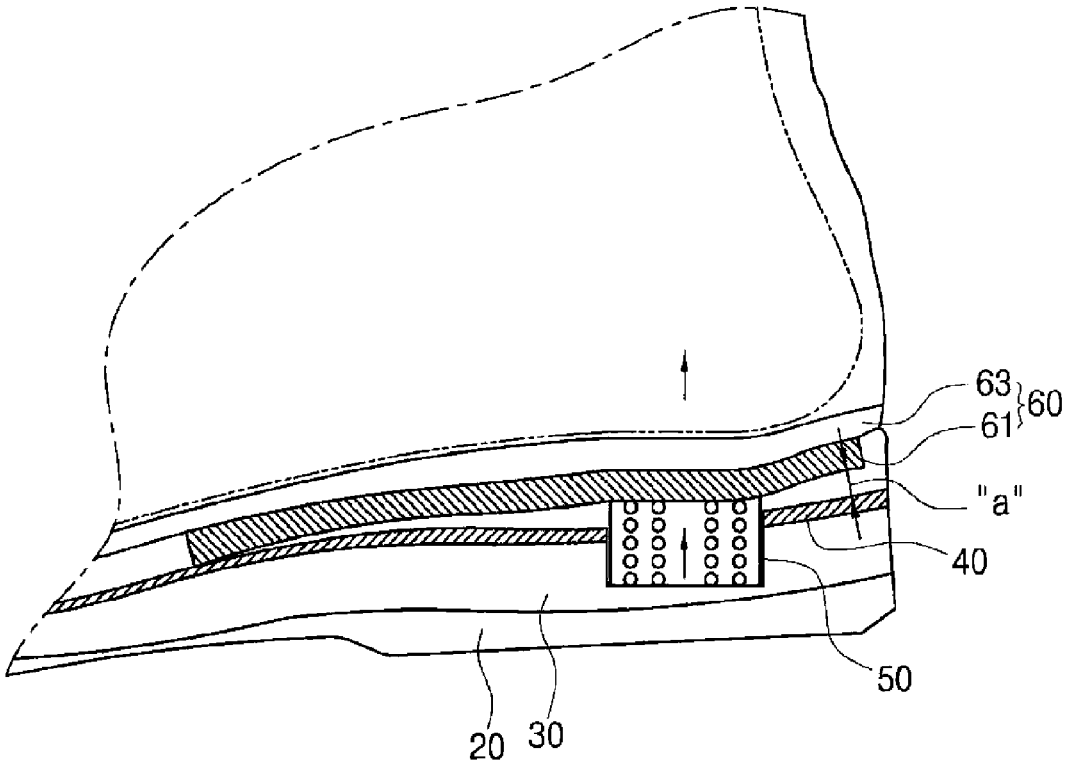
[Fig. 8]
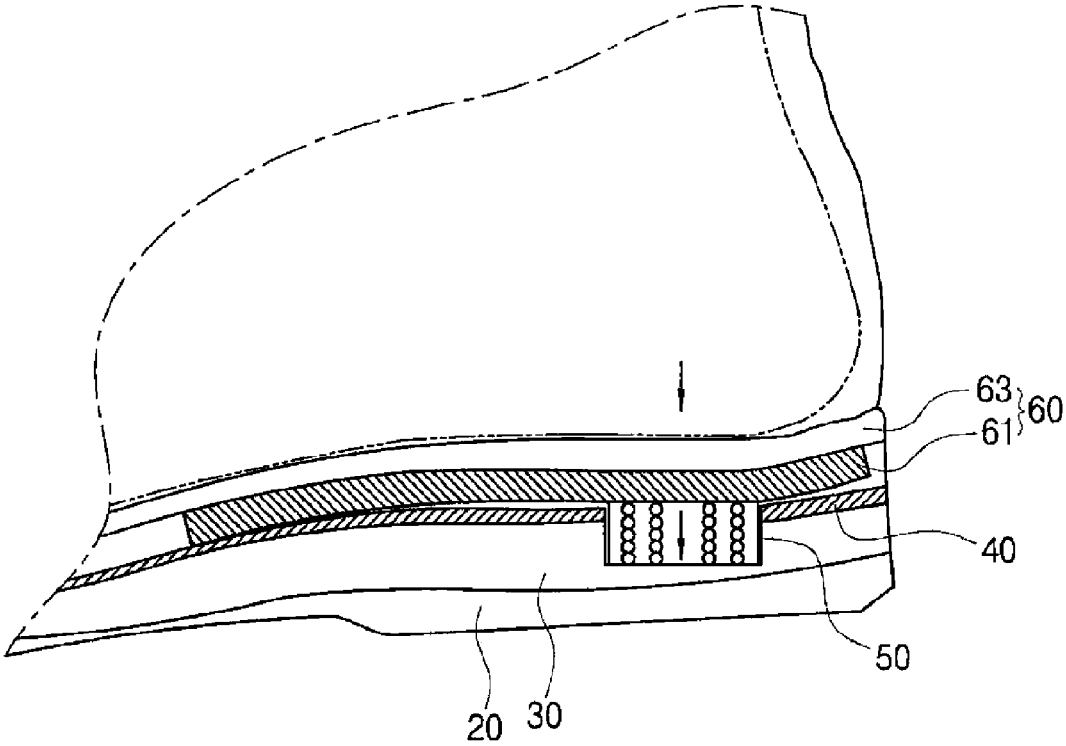

SHOES HAVING IMPACT ABSORPTION PART

RELATED APPLICATIONS

This application is a 371 application of International Application No. PCT/KR2007/005606, filed Nov. 8, 2007, which in turn claims priority from Korean Patent Application No. 10-2006-0112580, filed Nov. 15, 2006, both of which are incorporated herein by reference.

TECHNICAL FIELD

The present invention relates to a shoe, and more particularly to a shoe including a mid-sole groove formed at a mid-sole, a texon hole formed at a texon, and an impact absorption member inserted between the mid-sole and the texon hole so that the shoe can absorb impact exerted on user's knees and ankles while the user walks or exercises, thereby protecting them.

BACKGROUND ART

A method for minimizing impact exerted on user's knees and ankles while the user walks and exercises has been continuously developed. A common point of conventional shoes for absorbing impact is the fact that the shoes include a cushion device which is positioned at a same level as the texon and is built-in at a lower part of a texon or so as to absorb impact.

However, in such conventional shoes for absorbing impact, the cushion device cannot be replaced since it is built-in at the lower part of the texon. Therefore, there is a disadvantage in that the cushion can not be replaced even if the performance of the cushion device deteriorates.

Also, since the cushion device can not be replaced, it is impossible to cope with various impact varied according to the user's weight or level of exercise. Furthermore, performance of the cushioning is insufficient so that impact is still exerted on the user's knees or ankles.

DISCLOSURE OF INVENTION

Technical Problem

The present invention has been made in view of the above-mentioned problems, and the present invention provides a shoe, and more particularly a shoe including a mid-sole groove formed at a mid-sole, a texon hole formed at a texon, and an impact absorption member inserted between the mid-sole and the texon hole so that the shoe can absorbing impact exerted on user's knees and ankles while the user walks or exercises, thereby protecting them.

Technical Solution

In accordance with an aspect of the present invention, there is provided a shoe includes: an upper covering an upper part and a side part of a foot; an outer sole which is attached to a lower end of the upper and is positioned at a lowest end of the shoe so as to make contact with ground; a mid-sole which is attached to an upper part of the outer sole and has a mid-sole groove formed at a heel part of the mid-sole; a texon which is attached to an upper part of the mid-sole and has a texon hole formed at a part corresponding to the mid-sole groove; an impact absorbing member including a lower sheet making contact with a bottom surface of the mid-sole groove, an upper sheet detachably assembled with the lower sheet so as to make contact with a lower surface of the outer sole, an elastic spring vertically interposed between the upper sheet and the lower sheet, a female guider integrally formed at any one surface of an upper surface of the lower sheet and a lower surface of the upper sheet so as to be vertically inserted into the elastic spring, the female guider having an empty interior, and a male guider which is integrally formed at any one surface of the upper surface of the lower sheet and the lower surface of the upper sheet so as to be vertically inserted into the elastic spring and is inserted into an interior of the female guider, the impact absorbing member being inserted into the mid-sole groove and the texon hole and is positioned higher than the texon so as to absorb vertical impact; and a foot-bed of a dual structure including a lower sole of a soft material, which makes contact with the texon and the upper sheet of the impact absorbing member at a heel part of the shoe, and an upper sole which is attached to an upper surface of the lower sole and has a ventilating hole formed at a front heel part of the upper sole.

An upper sheet is further integrally formed at a periphery area of the upper sheet, a lower sheet is further integrally formed at a periphery area of the lower sheet, and the upper sheet is detachably inserted into the lower sheet.

A receiving groove for receiving both ends of the elastic spring is formed at the upper sheet and the lower sheet.

The impact absorbing member is higher than the texon as much as 5 mm~15 mm.

Advantageous Effects

According to the shoe including an impact absorbing member, which has such a structure, a mid-sole groove is formed at a mid-sole, a texon hole is formed at a texon, and an impact absorption member is inserted between the mid-sole and the texon hole, so that the shoe can absorbing impact exerted on user's knees and ankles while the user walks or exercises, thereby protecting the knees and ankles.

Also, since the impact absorbing member can be replaced, the shoe can cope with a user's weight or a level of walking or exercise, and a pumping operation is performed while the user walks or exercises so that generation of athlete's foot or foot odor can be minimized.

BRIEF DESCRIPTION OF THE DRAWINGS

The foregoing and other objects, features and advantages of the present invention will become more apparent from the following detailed description when taken in conjunction with the accompanying drawings in which:

FIG. 1 is a side sectional view illustrating a shoe including an impact absorbing member according to the present invention;

FIG. 2 is an exploded perspective view illustrating a shoe including an impact absorbing member according to the present invention;

FIG. 3 is a perspective view illustrating a foot-bed which is a part of the present invention;

FIG. 4 is a perspective view illustrating an impact absorbing member which is a part of the present invention;

FIG. 5 is an exploded perspective view illustrating an impact absorbing member which is a part of the present invention;

FIG. 6 is an exploded perspective view illustrating another impact absorbing member which is a part of the present invention; and FIGS. 7 and 8 are views illustrating a shoe including an impact absorbing member according to the present invention.

MODE FOR THE INVENTION

Hereinafter, an exemplary embodiment of a shoe including an impact absorbing member according to the present invention will be described in detail with reference to the accompanying drawings.

FIG. 1 is a side sectional view illustrating a shoe including an impact absorbing member according to the present invention, and FIG. 2 is an exploded perspective view illustrating a shoe including an impact absorbing member according to the present invention.

As shown in FIGS. 1 and 2, the shoe 100 having an impact absorbing member according to the present invention includes: an upper 10 covering an upper part and a side part of a foot; an outer sole 20 which is attached to a lower end of the upper 10 and is positioned at a lowest end of the shoe so as to make contact with ground; a mid-sole 30 which is attached to an upper part of the outer sole 20 and has a mid-sole groove 31 formed at a part corresponding to a heel; a texon 40 which is attached to the upper part of the mid-sole 30 and has a texon hole 41 formed at a part corresponding to the mid-sole groove 31; an impact absorbing member 50 which is inserted into the mid-sole groove 31 and the texon hole 41 so as to absorb impact vertically exerted, and is positioned higher than the texon 40; and a foot-bed 60 positioned at each upper surface of the texon 40 and the impact absorbing member 50.

The main characteristic of the shoe 100 having the impact absorbing member, which has such a structure, are that the texon hole 41 is formed at the texon 40, and the impact absorbing member 50 is inserted into the mid-sole groove 31 and the texon hole 41.

The mid-sole groove 31 having a predetermined shape is formed at a part corresponding to the heel. According to a manufacturing process, the mid-sole groove 31 formed at the part corresponding to the heel of the mid-sole 30 can have a cylinder-shape or a polygon-shape. Corresponding to the mid-sole groove 31, the texon hole 41 is formed at the part corresponding to the heel part of the texon 40.

The position at which the texon hole 41 is formed is same as the position at which the mid-sole groove 31 is formed, and the shape of the texon hole 41 is also same as the shape of the mid-sole groove 31. Particularly, if a horizontal section of the mid-sole groove 31 is a rectangular, a horizontal section of the texon hole 41 has to be rectangular. This is because the impact absorbing member 50 having a cylinder-shape or a three-dimensional polygon is inserted into the texon hole 41 and the mid-sole groove 31.

A horizontal sectional shape of the impact absorbing member 50 is the same as each horizontal sectional shape of the texon hole 41 and the mid-sole groove 31. When the impact absorbing member 50 is inserted into the texon hole 41 and the mid-sole groove 31, a lower surface of the impact absorbing member 50 makes contact with a bottom surface of the mid-sole groove 31, and a side surface of the impact absorbing member 50 is spaced from each inner wall of the texon hole 41 and the mid-sole groove 31 while having a dedicated interval. The dedicated interval is necessary for making it possible to easily insert the impact absorbing member 50 into the texon hole 41 and the mid-sole groove 31, and to easily separate the impact absorbing member 50 from the texon hole 41 and the mid-sole groove 31.

Meanwhile, the impact absorbing member 50 inserted into the mid-sole groove 31 and the texon hole 41 is positioned a little higher than the texon 40 at a normal state. Particularly, the impact absorbing member 50 is normally positioned higher as much as 5 mm~15 mm than the texon 40. As a result, when a user wearing the shoe walks, the height of the impact absorbing member 50 is lowered as much as 5 mm~15 mm. This is means that an elastic spring which will be described below absorbs impact.

As such, such impact absorbing member 50 is positioned higher than the texon 40, the user wearing the shoe can feel pain at the bottom of his/her foot. Therefore, a foot-bed 60 according to the present invention has a dual-structure as shown in FIG. 3. Particularly, a lower foot-bed 61 of hard material such as plastic is formed at a portion of the foot-bed 60, which makes direct contact with the upper surface of the impact absorbing member 50, and an upper foot-bed 63 of soft material is formed at a portion of the foot-bet 60, which is attached to an upper surface of the lower foot-bed 61 so as to make contact with the outer sole of the foot.

A portion of the foot-bed making direct contact with the impact absorbing member 50 is the lower foot-bed 61 of hard material such as plastic, and a portion of the foot-bet 61 making direct contact with the outer sole of the foot is the upper foot-bed 63 of soft material attached to the upper surface of the lower foot-bed 61. Therefore, the foot-bed can prevent burden exerted on the outer sole of the foot of the user wearing the shoe.

The lower foot-bed 61 is attached to only the heel part of the upper foot-bed 63, and a ventilation hole 65 is formed at a front heel part of the upper foot-bed 63. In such a structure, when the user wearing the shoe walks, air generated through a pumping operation performed by the impact absorbing member 50 can be transferred to the outer sole of the foot through the ventilation hole 65. Therefore, generation of foot odor and generation of athlete's foot can be restrained. In order to allow air generated by the pumping operation to be transferred to the ventilation hole 65, the lower foot-bed 61 is attached to the heel part of the upper foot-bed 63.

Then, the structure and operation of the impact absorbing member 50, which is a main element of the present invention, will be described below.

FIG. 4 is a perspective view illustrating an impact absorbing member, and FIG. 5 is an exploded perspective view illustrating an impact absorbing member.

As shown in FIG. 4, the impact absorbing member 50 according to the present invention includes a lower sheet 51 making contact with the bottom surface of the mid-sole 30; an upper sheet 54 detachably assembled with the lower sheet 51 so as to make contact with an lower surface of the lower foot-bed 61; and an elastic spring 57 vertically interposed between the upper sheet 54 and the lower sheet 51. Therefore, when impact is exerted from the upper sheet 4, the impact can be lessen due to the elastic spring 57.

Meanwhile, the upper sheet 54 and the lower sheet 51 can be detachably assembled with each other. As a result, the elastic spring 57 can be separated. As such, since the elastic spring 57 can be separated, the elastic spring 57, which has a large variety of elastic force according to the weight of the user or a lever of walking or exercise, can be replaced. Also, whenever an elastic performance of the elastic spring 57 is deteriorated, proper elastic performance can be secured by replacing the elastic spring 57.

The upper sheet 54 and the lower sheet 51 are detachably assembled with each other, and the elastic spring 57 can have various structures which can be separated. FIG. 5 shows an embodiment of the structure of them.

Particularly, so as to allow the upper sheet 54 to be detachably assembled with the lower sheet 51, the female guider 52, which is vertically inserted into the elastic spring 57 and has an empty interior thereof, is integrally formed at an upper surface of the lower sheet 51, and a male guider 55, which is vertically inserted into the elastic spring 57 and is also inserted into the interior of the female guider 52, is integrally formed at an lower surface of the upper sheet 54.

As above described structure, when the male guider 55 integrally formed at the lower surface of the upper sheet 54 is inserted into the female guider 52 integrally formed at the upper surface of the lower sheet 51, they don t move in a left or right direction, and are easily assembled or disassembled with each other. The female guider 52 and the male guider 55 allow the lower sheet 51 and the upper sheet 54 to be stably and easily assembled or disassembled with each other, also prevent the elastic spring 57 from releasing, and can function as a guide when the elastic spring 57 retracts and extends.

According to the structure as shown in FIG. 5, the female guider 52 is integrally formed at the lower sheet 51, and the male guider 55 is integrally formed at the upper sheet 54. As the case may be, the structure can be modified into a structure where the male guider 55 is integrally formed at the lower sheet 51, and the female guider 52 is integrally formed at the upper sheet 54.

Meanwhile, so as to allow the elastic spring 57 to be stably fixed and prevent the elastic spring 57 from releasing, a receiving groove 56, which can receive both ends of the elastic spring 57, is preferably formed at the upper sheet 54 and the lower sheet 51.

The impact absorbing member 50 as shown in FIG. 5 includes the elastic spring 57, the upper sheet 54, and the lower sheet 51. As the case may be, the impact absorbing member 50 can include a side part as shown in FIG. 6.

Particularly, as shown in FIG. 6, an upper sheet 59, which is integrally formed at the upper sheet 54, is further formed at a periphery area of the upper sheet 54, and a lower sheet 58, which is formed integrally with the lower sheet 51, is further formed at a periphery area of the lower sheet 51. But, the upper sheet 59 and the lower sheet 58 can be inserted into each other and be separated from each other.

In FIG. 6, the embodiment of the lower sheet 58 having an empty interior will be described. Therefore, the upper sheet 59 can be inserted into the empty interior of the lower sheet 58 so as to be assembled with the lower sheet 58, and is also easily disassembled from the lower sheet 58. As the case may be, the interior of the upper sheet 59 is empty, the lower sheet 58 is inserted into the empty interior of the upper sheet 59 so as to be assembled with the upper sheet 59, and is also easily disassembled therewith. Since a female guider, a male guider, and a receiving groove, etc., which are shown in FIG. 6, are same as them which has been described with reference to FIG. 5, the descriptions of them will be omitted.

FIGS. 7 and 8 are views illustrating a state of the shoe when the user wearing the shoe allows the shoe to leave the ground, and a state of the shoe when the user allows the shoe to make contact with the ground, respectively.

FIG. 7 is a view illustrating a state where the shoe leaves the ground. As shown in FIG. 7, when the user allows the shoe making contact with the ground to leave the ground, the impact absorbing member 50 is elevated by elastic force of the elastic spring. Next, when the user allows the shoe to make contact with the ground, the impact absorbing member 50 is lowered by weight of the user as shown in FIG. 8. At this time, the elastic spring absorbs impact energy so that the impact can be lessened.

INDUSTRIAL APPLICABILITY

The present invention provides a shoe having a modularized impact absorbing member, which is detachably inserted into a heel part of the shoe and is formed higher than the texon, and a foot-bed having a dual structure attached to the shoe.

Therefore, in the present invention, since an impact absorbing member having various shapes can be replaced in one shoe, the shoe can be specially and easily used in a case where there is a need for changing elastic force of the impact absorbing member according a level of the user's walking or exercise or in a case where shock-absorbing operation can not be sufficiently performed because elastic force of the impact absorbing member is lessened.

The invention claimed is:

1. A shoe comprising: an upper covering an upper part and a side part of a foot; an outer sole which is attached to a lower end of the upper and is positioned at a lowest end of the shoe so as to make contact with ground; a mid-sole which is attached to an upper part of the outer sole and has a mid-sole groove formed at a heel part of the mid-sole; a texon which is attached to an upper part of the mid-sole and has a texon hole formed at a part corresponding to the mid-sole groove; an impact absorbing member including a lower sheet making contact with a bottom surface of the mid-sole groove, an upper sheet detachably assembled with the lower sheet so as to make contact with a lower surface of the outer sole, an elastic spring vertically interposed between the upper sheet and the lower sheet, a female guider integrally formed at any one surface of an upper surface of the lower sheet and a lower surface of the upper sheet so as to be vertically inserted into the elastic spring, the female guider having an empty interior, and a male guider which is integrally formed at any one surface of the upper surface of the lower sheet and the lower surface of the upper sheet so as to be vertically inserted into the elastic spring and is inserted into an interior of the female guider, the impact absorbing member being inserted into the mid-sole groove and the texon hole and is positioned higher than the texon so as to absorb vertical impact; and a foot-bed of a dual structure including a lower sole of a soft material, which makes contact with the texon and the upper sheet of the impact absorbing member at a heel part of the shoe, and an upper sole which is attached to an upper surface of the lower sole and has a ventilating hole formed at a front heel part of the upper sole.

2. The shoe claimed in claim 1, wherein an upper sheet is further integrally formed at a periphery area of the upper sheet, a lower sheet is further integrally formed at a periphery area of the lower sheet, and the upper sheet is detachably inserted into the lower sheet.

3. The shoe claimed in claim 1, wherein a receiving groove for receiving both ends of the elastic spring is formed at the upper sheet and the lower sheet.

4. The shoe claimed in claim 1, wherein the impact absorbing member is higher than the texon as much as 5 mm~1.5 mm.

* * * * *